US008274235B2

(12) United States Patent
Choi et al.

(10) Patent No.: US 8,274,235 B2
(45) Date of Patent: Sep. 25, 2012

(54) INVERTER DEVICE AND DRIVING METHOD THEREOF

(75) Inventors: Jae-Soon Choi, Gyonggi-do (KR); Hak-Hee Lee, Gyonggi-do (KR); Il-Young Jung, Gyonggi (KR); Eung-Woo Lee, Gyonggi (KR)

(73) Assignee: Fairchild Korea Semiconductor Ltd., Bucheon (KR)

( * ) Notice: Subject to any disclaimer, the term of this patent is extended or adjusted under 35 U.S.C. 154(b) by 304 days.

(21) Appl. No.: 12/815,193

(22) Filed: Jun. 14, 2010

(65) Prior Publication Data

US 2010/0327760 A1 Dec. 30, 2010

(30) Foreign Application Priority Data

Jun. 25, 2009 (KR) ..... 10-2009-0057273

(51) Int. Cl.
*H05B 37/02* (2006.01)

(52) U.S. Cl. ..... 315/219; 315/224; 315/307; 315/308

(58) Field of Classification Search ..... 315/291, 315/307, 308, 224, 225, 226, 219, DIG. 5, 315/DIG. 7
See application file for complete search history.

(56) References Cited

U.S. PATENT DOCUMENTS 7,265,497 B2 * 9/2007 Chen et al. ..... 315/209 R
7,423,384 B2 9/2008 Ren et al.
2009/0278466 A1 * 11/2009 Wang ..... 315/219

OTHER PUBLICATIONS

OZ9939-DS-1.1 LCDM Inverter Controller, Oct. 27, 2005, pp. 1-11, O2Micro International Limited.

* cited by examiner

*Primary Examiner* — David Hung Vu
(74) *Attorney, Agent, or Firm* — Okamoto & Benedicto LLP

(57) ABSTRACT

An inverter according to exemplary embodiment of the present invention generates a plurality of feedback voltages corresponding to driving voltages of discharge lamps. The inverter generates a first minimum voltage having a smaller feedback voltage of a plurality of feedback voltages and compares the first minimum voltage and a short circuit reference voltage to determine a short circuit of at least two discharge lamps. Also, the inverter generates a plurality of feedback voltages corresponding to driving currents of a plurality of discharge lamps, generates a second minimum voltage having a smaller feedback voltage of a plurality of the feedback voltages, and compares the second minimum voltage and an open circuit reference voltage to determine the open circuit of the at least two discharge lamps.

28 Claims, 14 Drawing Sheets

INVERTER DEVICE AND DRIVING METHOD THEREOF

CROSS-REFERENCE TO RELATED APPLICATION

This application claims priority to and the benefit of Korean Patent Application No. 10-2009-0057273 filed in the Korean Intellectual Property Office on Jun. 25, 2009, the entire contents of which are incorporated herein by reference.

BACKGROUND OF THE INVENTION (a) Field of the Invention

The present invention relates to an inverter. More particularly, the present invention relates to a protection circuit of the inverter to supply power for driving a lamp.

(b) Description of the Related Art

In order to drive a discharge lamp, a high voltage is necessary, and an inverter is generally used in order to produce the high voltage. An inverter for driving the lamp transforms an input DC power source to an AC power source and supplies an AC voltage and an AC current to a discharge lamp. The inverter includes a transformer, a first side of the transformer is connected to a half- or a full-bridge circuit, and a second side of the transformer is connected to the lamp. The discharge lamp is driven by the AC voltage and the AC current generated at the second side. The inverter begins operating protection for safety and reliability of a lamp driver and the inverter when the lamp develops an open circuit or short circuit state. In detail, when the discharge lamp becomes an open circuit lamp, an output terminal of the inverter develops an open circuit state, and when the discharge lamp becomes a short circuit lamp, the output terminal of the inverter develops a short circuit state. The inverter senses feedback voltage and current knowing a state of the output terminal for a protection operation.

When the inverter includes a plurality of output terminals and a plurality of the output terminals are respectively connected to a plurality of lamps, the inverter must have outside elements corresponding to the number of lamps in order to detect an open circuit lamp or a short circuit lamp among the plurality of lamps. In detail, the inverter needs a plurality of feedback signals corresponding to a voltage and a current supplied to each of the plurality of lamps for a protection operation. The inverter includes outside elements such as diodes according to the number of the plurality of lamps in order to generate the plurality of feedback signals. Then, according to forming outside elements, the entire area of the inverter increases and manufacturing cost also increases.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an inverter and a driving method including fewer external elements for a protection operation. In one aspect of the present invention, an inverter supplying power to at least two discharge lamps includes: a first feedback information generation unit for generating a first feedback voltage corresponding to a driving voltage of a first discharge lamp of at least two discharge lamps; a second feedback information generation unit for generating a second feedback voltage corresponding to a driving voltage of a second discharge lamp of at least two discharge lamps; and an inverter driver for comparing a first minimum voltage having a smaller feedback voltage of the first and second feedback voltages and a short circuit reference voltage in order to determine at least one short circuit discharge lamp of the at least two discharge lamps, and for sensing the at least one short circuit discharge lamp by using the comparison result and a first sawtooth wave signal having a predetermined period. The inverter further includes a third feedback information generation unit for generating a third feedback voltage corresponding to a driving current of the first discharge lamp and a fourth feedback information generation unit for generating a fourth feedback voltage corresponding to a driving current of the second discharge lamp. The inverter driver compares a second minimum voltage having a smaller feedback voltage of the third and fourth feedback voltages and an open circuit reference voltage in order to determine the at least one open circuit discharge lamp of the least two discharge lamps, and senses the at least one open circuit discharge lamp by using the comparison result and the first sawtooth wave signal. The inverter driver includes an open circuit comparator for comparing the second minimum voltage and the open circuit reference voltage and for generating an open circuit detection signal according to the comparison result, and an open circuit lamp protector for counting a number of the second minimum voltage periods including a time period when the second minimum voltage is greater than the reference voltage by using the open circuit detection signal and for determining that the at least one open circuit discharge lamp is present if the count result is different from a count result of a number of the first sawtooth wave signal periods. The open circuit lamp protector includes: a sync signal generator for generating a sync signal being a pulse signal that is synchronized with the first sawtooth wave signal and has the same period; a clock signal generator for generating a clock signal that is synchronized with the sync signal and has twice the period than the period of the sync signal; an open circuit flip-flop for outputting the clock signal as an open circuit signal during one period of the open circuit detection signal in synchronization with the open circuit detection signal; and an open circuit determining unit for determining that the at least one open circuit discharge lamp is present when the level of the open circuit signal is not changed during a predetermined delay time period. The open circuit determining unit includes:

a first delay unit for generating a second level first detection signal when the open circuit signal is maintained in the first level during the predetermined delay time period and a fourth level first detection signal when the open circuit signal is a third level; a second delay unit for generating a second level second detection signal when an inversion open circuit signal of which the open circuit signal is inverted is maintained in the first level during the predetermined delay time period and a fourth level second detection signal when the inversion open circuit signal is the third level; and an operator for generating an open circuit protection signal when the first detection signal or the second detection signal is the second level. The inverter further includes a switch unit for receiving a power source voltage and for generating a square wave voltage by the switching operation, and a transformer for including at least two second side coils supplying the driving voltages and the driving currents to the at least two discharge lamps by using the square wave voltage. The first discharge lamp is connected to a first terminal of the second coil of the at least two second side coils, and a third discharge lamp is connected to a second terminal of the second coil. The third feedback voltage generator includes: a first resistor through which the driving current of the first discharge lamp flows; a second resistor through which a driving current of the third discharge lamp flows; a first diode including an anode to which a voltage of the first resistor is applied; and a second diode including an anode to which a voltage of the second resistor is applied and the cathode thereof connected to a cathode of the first diode. The third feedback voltage is a cathode voltage of the first and second diodes. The second discharge lamp is connected to a first terminal of a third coil of at least two second side coils, and the third discharge lamp is connected to a second terminal of the third coil. The fourth feedback voltage generator includes: a first resistor through which the driving current of the second discharge lamp flows; a second resistor through which a driving current of the third discharge lamp flows; a first diode including an anode to which a voltage of the first resistor is applied; and a second diode including an anode to which a voltage of the second resistor is applied and the cathode of which is connected to a cathode of the first diode. The fourth feedback voltage is a cathode voltage of the first and second diodes.

A period of the first sawtooth wave signal is a half of a period of the switching operation.

In one aspect of the present invention, the inverter driver of the inverter includes a short circuit comparator for comparing the first minimum voltage and the short circuit reference voltage and for generating a short circuit detection signal according to the comparison result, and a short circuit lamp protector for counting a number of the first minimum voltage periods that includes a time period when the first minimum voltage is greater than the reference voltage by using the short circuit detection signal and for determining that the at least one short circuit discharge lamp is present when the count result is different from a count result of a number of the first sawtooth wave signal periods. The short circuit lamp protector includes: a sync signal generator for generating a sync signal being a pulse signal that is synchronized with the first sawtooth wave signal and has the same period; a clock signal generator for generating a clock signal that is synchronized with the sync signal and has twice the period of that of the sync signal; a short circuit flip-flop for outputting the clock signal as the short circuit signal during one period of the short circuit detection signal in synchronization with the short circuit detection signal; and a short circuit determining unit for determining that the at least one short circuit discharge lamp is present when the level of the short circuit signal is not changed during a predetermined delay time period. The short circuit determining unit includes a first delay unit for generating a second level first detection signal when the short circuit signal is maintained in the first level during the predetermined delay time period and a fourth level first detection signal when the short circuit signal is a third level; a second delay unit for generating a second level second detection signal when an inversion short circuit signal of which the short circuit signal is inverted is maintained in the first level during the predetermined delay time period and a fourth level second detection signal when the inversion short circuit signal becomes the third level; and an operator for generating a short circuit protection signal when the first detection signal or the second detection signal is the second level. In one aspect of the present invention, the inverter further includes a switch unit for receiving a power source voltage and for generating a square wave voltage by the switching operation, and a transformer for including at least two second side coils supplying the driving voltages and the driving currents to the at least two discharge lamps by using the square wave voltage. The first discharge lamp is connected to a first terminal of a second coil of the at least two second side coils, and a third discharge lamp is connected to a second terminal of the second coil. The first feedback voltage generator includes: a first capacitor including a first terminal connected to the first discharge lamp and the first terminal of the second coil; a second capacitor including a first terminal connected to a second terminal of the first capacitor; a first diode including an anode to which a voltage of the first terminal of the second capacitor is applied; a third capacitor including a first terminal connected to the third discharge lamp and the second terminal of the second coil; a fourth capacitor including a first terminal connected to a second terminal of the third capacitor; and a second diode including an anode to which a voltage of the first terminal of the fourth capacitor is applied and a cathode connected to a cathode of the first diode. The first feedback voltage is a cathode voltage of the first and second diodes. The second discharge lamp is connected to a first terminal of a second coil of the at least two second side coils, and a third discharge lamp is connected to a second terminal of the second coil. The second feedback voltage generator includes: a first capacitor including a first terminal connected to the second discharge lamp and the first terminal of the second coil; a second capacitor including a first terminal connected to a second terminal of the first capacitor; a first diode including an anode to which a voltage of the first terminal of the second capacitor is applied; a third capacitor including a first terminal connected to the third discharge lamp and the second terminal of the second coil; a fourth capacitor including a first terminal connected to a second terminal of the third capacitor; and a second diode including an anode to which a voltage of the first terminal of the fourth capacitor is applied and a cathode connected to a cathode of the first diode. The second feedback voltage is a cathode voltage of the first and second diodes. A period of the first sawtooth wave signal is half the period of the switching operation. In another aspect of the present invention, a driving method of an inverter for supplying power to at least two discharge lamps includes: a step for generating a first feedback voltage corresponding to a driving voltage of a first discharge lamp of the at least two discharge lamps; a step for generating a second feedback voltage corresponding to a driving voltage of a second discharge lamp of the at least two discharge lamps; a step for generating a first minimum voltage having a smaller feedback voltage by comparing the first and second feedback voltages; a step for comparing the first minimum voltage to a short circuit reference voltage in order to determine whether at least one short circuit discharge lamp of the at least two discharge lamps is present; and a step for sensing the at least one short circuit discharge lamp of the at least two discharge lamps by using the comparison result and a first sawtooth wave signal having a predetermined period.

The driving method of the inverter further includes: a step for generating a third feedback voltage corresponding to a driving current of the first discharge lamp; a step for generating a fourth feedback voltage corresponding to a driving current of the second discharge lamp; a step for generating a second minimum voltage having a smaller feedback voltage of the third and fourth feedback voltages; a step for comparing the second minimum voltage to an open circuit reference voltage in order to determine whether at least one open circuit discharge lamp of the at least two discharge lamps is present; and a step for sensing the open circuit lamp by using the comparison result and the first sawtooth wave signal.

The step for sensing the open circuit lamp includes: a step for comparing the second minimum voltage and the open circuit reference voltage and generating an open circuit detection signal according to the comparison result; a step for counting a number of second minimum voltage periods that include a time period when the second minimum voltage is greater that the reference voltage by using the open circuit detection signal; and a step for determining that at least one open circuit discharge lamp is present when the count result is different from a count result of a number of the first sawtooth wave signal periods.

The step for determining the short circuit lamp includes: a step for comparing the first minimum voltage to the short circuit reference voltage and generating a short circuit detection signal according to the comparison result; a step for counting a number of the first minimum voltage periods that include a time period when the first minimum voltage is greater than the reference voltage by using the short circuit detection signal; and a step for determining that the at least one short circuit discharge lamp is present when the count result is different from the first sawtooth wave signal period count result. In another aspect of the present invention, an inverter for supplying a power source to at least two discharge lamps includes: a first feedback information generation unit for generating a first voltage and a second voltage corresponding to each driving voltage of the at least two discharge lamps; and an inverter driver that respectively rectifies the first voltage and the second voltage, compares the first minimum voltage having a smaller voltage of the rectified first voltage and the rectified second voltage to a short circuit reference voltage in order to determine whether at least one short circuit discharge lamp of the at least two discharge lamps is present, and senses the at least one short circuit discharge lamp of the at least two discharge lamps by using the comparison result and a first sawtooth wave signal having a predetermined period. The inverter further includes a second feedback information generator for generating the third voltage and the fourth voltage corresponding to each driving current of the at least two discharge lamps, and the inverter driver respectively rectifies the third voltage and the fourth voltage, compares a second minimum voltage having a smaller voltage of the rectified third and fourth voltages to a open circuit reference voltage in order to determine whether at least one open discharge lamp of the at least two discharge lamps is present, and senses the open circuit lamp of the at least two discharge lamps by using the comparison result and the first sawtooth wave signal. The inverter driver includes: an open circuit comparator for comparing the second minimum voltage and the open circuit reference voltage and for generating an open circuit detection signal according to the comparison result; and an open circuit lamp protector for counting a number of the second minimum voltage periods including a time period when the second minimum voltage is greater than the reference voltage by using the open circuit detection signal and for determining that the at least one open circuit discharge lamp is present if the count result is different from a count result of a number of the first sawtooth wave signal periods. The open circuit lamp protector includes: a sync signal generator for generating a sync signal being a pulse signal that is synchronized with the first sawtooth wave signal and has the same period; a clock signal generator for generating a clock signal that is synchronized with the sync signal and has twice that period of that of the sync signal; an open circuit flip-flop for outputting the clock signal as an open circuit signal during one period of the open circuit detection signal in synchronization with the open circuit detection signal; and an open circuit determining unit for determining that the at least one open circuit discharge lamp is present when the level of the open circuit signal is not changed during a predetermined delay time period. The open circuit determining unit includes: a first delay unit for generating a second level first detection signal when the open circuit signal is maintained in the first level during the predetermined delay time period and a fourth level first detection signal when the open circuit signal is a third level; a second delay unit for generating a second level second detection signal when an inversion open circuit signal of which the open circuit signal is inverted is maintained in the first level during the predetermined delay time period and a fourth level second detection signal when the inversion open circuit signal is the third level; and an operator for generating an open circuit protection signal when the first detection signal or the second detection signal is the second level. The inverter driver includes: a short circuit comparator for comparing the first minimum voltage and the short circuit reference voltage and for generating a short circuit detection signal according to the comparison result; and a short circuit lamp protector for counting a number of the first minimum voltage periods that includes a time period when the first minimum voltage is greater than the reference voltage by using the short circuit detection signal and for determining that the at least one short circuit discharge lamp is present when the count result is different from a count result of a number of the first sawtooth wave signal periods. The short circuit lamp protector includes: a sync signal generator for generating a sync signal being a pulse signal that is synchronized with the first sawtooth wave signal and has the same period; a clock signal generator for generating a clock signal that is synchronized with the sync signal and has twice the period of that of the sync signal; a short circuit flip-flop for outputting the clock signal as the short circuit signal during one period of the short circuit detection signal in synchronization with the short circuit detection signal; and a short circuit determining unit for determining that the at least one short circuit discharge lamp is present when the level of the short circuit signal is not changed during a predetermined delay time period. The short circuit determining unit includes: a first delay unit for generating a second level first detection signal when the short circuit signal is maintained in the first level during the predetermined delay time period and a fourth level first detection signal when the short circuit signal is a third level; a second delay unit for generating a second level second detection signal when an inversion short circuit signal of which the short circuit signal is inverted is maintained in the first level during the predetermined delay time period and a fourth level second detection signal when the inversion short circuit signal becomes the third level; and an operator for generating a short circuit protection signal when the first detection signal or the second detection signal is the second level. According to the present invention, a driving voltage and a driving current of discharge lamps are transmitted through a diode so that they can sense an open circuit lamp and a short circuit lamp. Conventionally, many diodes were needed according to the number of discharge lamps. However, a feedback voltage regarding a driving voltage and a driving current of four discharge lamps can be transmitted through four diodes in the embodiment of the present invention. Accordingly, the present invention can provide an inverter and a driving method for finding an open circuit lamp and a short circuit lamp with a simple configuration.

DETAILED DESCRIPTION OF THE EMBODIMENTS

Figure 1:
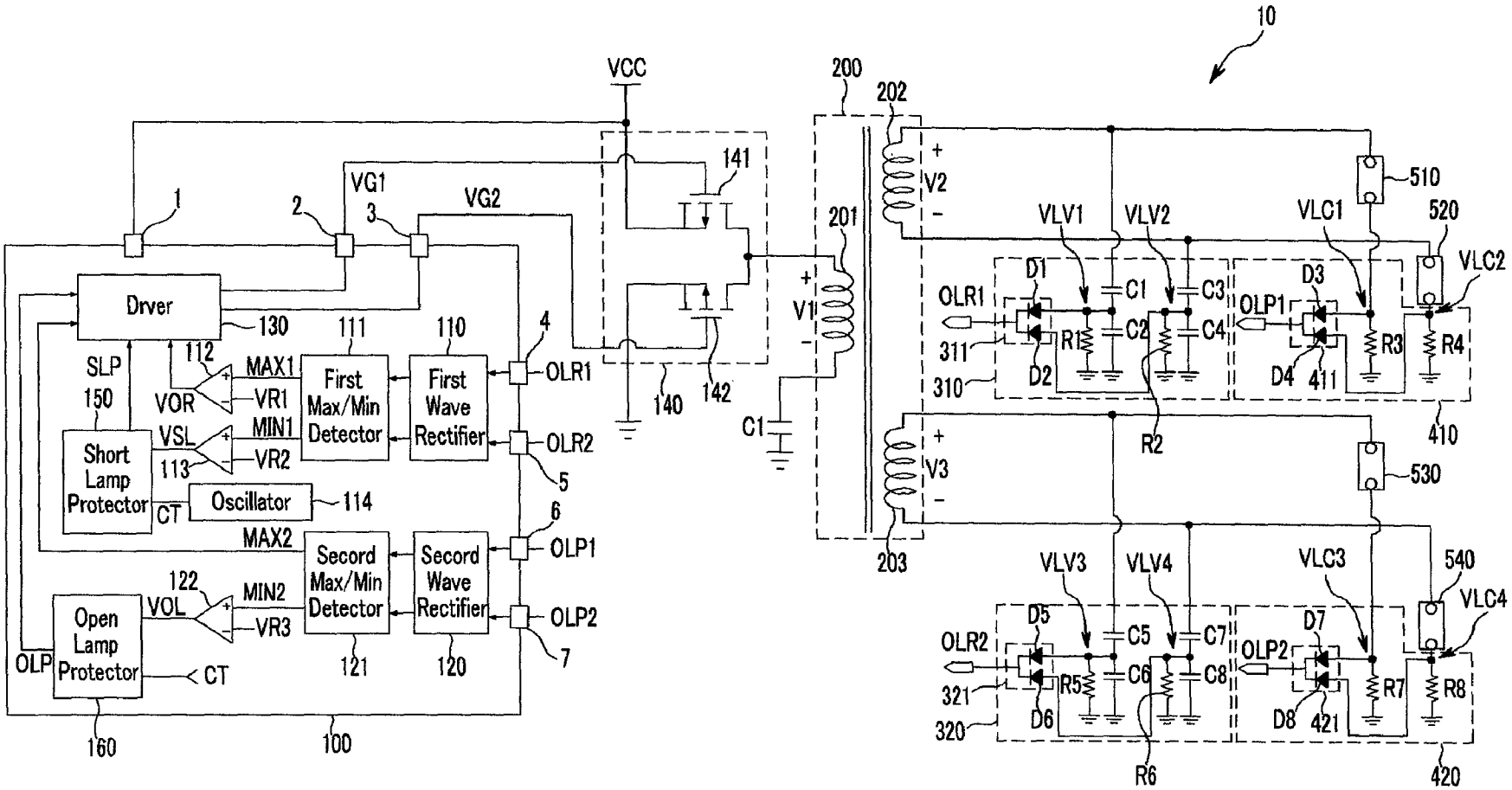
FIG. 1 shows an inverter according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements. In the following detailed description, only certain exemplary embodiments of the present invention have been shown and described, simply by way of illustration. Hereinafter, referring to drawings, an inverter and a driving method will be described according to an exemplary embodiment of the present invention.

FIG. 1 shows an inverter according to an exemplary embodiment of the present invention. As shown in FIG. 1, an inverter 10 according to an exemplary embodiment of the present invention includes an inverter driver 100, a switch unit 140, a transformer 200, and first to fourth feedback information generation units 310, 320, 410, and 420.

The inverter 10 supplies discharge lamps 510, 520, 530, and 540 with electric power, and emits the discharge lamps 510, 520, 530, and 540 at an appropriate brightness. The switch unit 140 receives a DC power source voltage Vcc and transfers a square wave voltage Vo to the transformer 200 with the switching operation of switching elements. The switch unit 140 may be configured to use a push-pull method, a half-bridge method, or a full-bridge method. According to an exemplary embodiment of the present invention, the switch unit 140 is configured to use a half-bridge method.

In detail, the switch unit 140 of the half-bridge method includes transistors 141 and 142. The transistors 141 and 142 are n-channel transistors. Gate electrodes of the transistors 141 and 142 are applied gate signals VG1 and VG2. A drain electrode of the transistor 141 is connected to a first terminal of a first side coil 201 of the transformer 200, and a source electrode of the transistor 141 receives a power source voltage Vcc. A drain electrode of the transistor 142 is connected to the first terminal of a first side coil 201 of the transformer 200, and a source electrode of the transistor 142 is grounded. The transistor 141 and the transistor 142 alternately operate switching. Accordingly, when the transistor 141 is in a turned-on state and the transistor 142 is in a turned-off state, a square wave voltage Vo becomes the power source voltage Vcc level, and when the transistor 141 is in a turned-off state and the transistor 142 is in a turned-on state, the square wave voltage Vo becomes a ground voltage level. The transformer 200 includes the first coil 201, a second coil 202, and a third coil 203.

The first coil 201 is configured at a first side and the second coil 202 and the third coil 203 are configured at a second side of the transformer 200. A square wave voltage V1, wherein a DC element is removed by a capacitor C, is input to the transformer 200. A resonance between a leakage inductance (not shown) of the second coil 202 and capacitors C1 to C4 occurs by the square wave voltage V1 at both terminals of the first coil 201, and an AC voltage V2 occurs at both terminals of the second coil 202. Additionally, a resonance between a leakage inductance (not shown) of the second coil 203 and capacitors C5 to C8 occurs by the square wave voltage V1, and an AC voltage V3 occurs at both terminals of the second coil 203.

The AC voltage V2 is supplied to the discharge lamps 510 and 520, and the AC voltage V3 is supplied to the discharge lamps 530 and 540. Hereinafter, a voltage supplied to each of the discharge lamps 510 to 540 is called a driving voltage, and a current flowing through each of the discharge lamps 510 to 540 is called a driving current. According to an exemplary embodiment of the present invention, in order to drive four discharge lamps, two coils are formed at the second side of the transformer, but in order to drive two discharge lamps, one coil is formed at the second side of the transformer. The first and second feedback information generation units 310 and 320 generate feedback information about each of driving voltages corresponding to each of the discharge lamps 510 to 540, and the third and fourth feedback information generation units 410 and 420 generate feedback information about each of driving currents corresponding to each of the discharge lamps 510 to 540.

The first feedback information generation unit 310 generates the feedback information regarding the driving voltages at the discharge lamps 510 and 520 as a feedback voltage OLR1 and transmits the feedback voltage OLR1 to the inverter driver 100. The first feedback information generation unit 310 includes a diode 311, the capacitors C1 to C4, and resistors R1 and R2. The capacitors C1 and C2 are connected between a first terminal of the discharge lamp 510 and a ground in series, and a node of the capacitors C1 and C2 is connected to the diode 311. A first terminal of the resistor R1 is connected with the node of the capacitors C1 and C2 and the diode 311. The capacitors C3 and C4 are connected between a first terminal of the discharge lamp 520 and the ground in series, and a node of the capacitors C3 and C4 is connected to the diode 311.

A first terminal of the resistor R2 is connected with the node of the capacitors C3 and C4 and the diode 311. In case there is no diode D1, a voltage VLV1 is a voltage forming a sine wave based on a 0V voltage. However, when the diode D1 is connected as shown in FIG. 1, the voltage VLV1 is shifted down and forms the sine wave based on a negative voltage. The resistor R1 shifts up the voltage VLV1. Thus, the voltage VLV1 forms a sine wave based on a 0V voltage. The resistors R2, R5, and R6 perform the role of being identical with the resistor R1. The diode 311 includes two diodes D1 and D2. The voltage VLV1 is applied to an anode electrode of the diode D1 and a voltage VLV2 is applied to an anode electrode of the diode D2. The voltage VLV1 is the feedback information corresponding to the driving voltage of the discharge lamp 510, and the voltage VLV2 is the feedback information corresponding to the driving voltage of the discharge lamp 520.

The diode 311 alternately transmits the feedback information of the discharge lamp 510 and the discharge lamp 520 to the inverter driver 100. The driving voltages of the discharge lamp 510 and the discharge lamp 520 are AC voltages having a phase difference of 180° from each other. When the driving voltage of the discharge lamp 510 is a positive voltage and the driving voltage of the discharge lamp 520 is a negative voltage, the voltage VLV1 becomes a positive voltage and the voltage VLV2 becomes a negative voltage. Then, the diode D1 is turned on and the diode D2 is turned off so that the voltage VLV1 is transmitted through the diode D1 to the inverter driver 100.

On the contrary, when the driving voltage of the discharge lamp 520 is a positive voltage and the driving voltage of the discharge lamp 510 is a negative voltage, the voltage VLV2 becomes a positive voltage and the voltage VLV1 becomes a negative voltage. Then, the diode D2 is turned on and the diode D1 is turned off so that the voltage VLV2 is transmitted through the diode D2 to the inverter driver 100. As described above, the first feedback voltage OLR1 alternately has the feedback information corresponding to each driving voltage of the discharge lamp 510 and the discharge lamp 520. Substantially, when the diode D1 is turned on, the first feedback voltage OLR1 is transmitted to the inverter driver 100 by being reduced as the threshold voltage of the diode D1 from the voltage VLV1, and when the diode D2 is turned on, the first feedback voltage OLR1 is transmitted to the inverter driver 100 by being reduced as the threshold voltage of the diode D2 from the voltage VLV2.

The second feedback information generation unit 320 has the same configuration and operation as the first feedback information generation unit 310. Thus, detailed descriptions will be omitted. The second feedback information generation unit 320 generates a second feedback voltage OLR2, and the second feedback voltage OLR2 has the feedback information corresponding to each driving voltage of the discharge lamp 530 and the discharge lamp 540. The third feedback information generation unit 410 includes a diode 411 and resistors R3 and R4. A first terminal of the resistor R3 is connected to the second terminal of the discharge lamp 510, and the second terminal of the resistor R3 is grounded. A first terminal of the resistor R4 is connected to the second terminal of the discharge lamp 520, and a second terminal of the resistor R4 is grounded.

The diode 411 includes a diode D3 and a diode D4. An anode electrode of the diode D3 is connected to the first terminal of the resistor R3, and a third feedback voltage OLP1 corresponding to the driving current of the discharge lamp 510 is applied to the anode electrode of the diode D3. An anode electrode of the diode D4 is connected to the first terminal of the resistor R4, and the third feedback voltage OLP1 corresponding to the driving current of the discharge lamp 520 is applied to the anode electrode of the diode D4. Like the driving voltage, the driving current of the discharge lamp 510 and the driving current of the discharge lamp 520 are AC currents having a phase difference of 180° from each other.

When the voltage VLC1 becomes a positive voltage by the driving current of the discharge lamp 510 and the voltage VLC2 becomes a negative voltage by the driving current of the discharge lamp 520, the diode D3 is turned on and the diode D4 is turned off so that the voltage VLC1 is transmitted through the diode D3 to the inverter driver 100. When the voltage VLC2 becomes a positive voltage by the driving current of the discharge lamp 520 and the voltage VLC1 becomes a negative voltage by the driving current of the discharge lamp 510, the diode D4 is turned on and the diode D3 is turned off so that the voltage VLC2 is transmitted through the diode D4 to the inverter driver 100.

As described above, the third feedback voltage OLP1 alternatively has the feedback information corresponding to each driving current of the discharge lamp 510 and the discharge lamp 520. Substantially, when the diode D3 is turned on, the third feedback voltage OLP1 is transmitted to the inverter driver 100 to be reduced as the threshold voltage of the diode D3 from the voltage VLC1, and when the diode D4 is turned on, the third feedback voltage OLP1 is transmitted to the inverter driver 100 being reduced as the threshold voltage of the diode D4 from the voltage VLC2.

The fourth feedback information generation unit 420 has the same configuration and operation as the third feedback information generation unit 410. Thus, detailed descriptions will be omitted. The fourth feedback information generation unit 420 generates a fourth feedback voltage OLP2, and the fourth feedback voltage OLP2 has the feedback information corresponding to each driving current of the discharge lamp 530 and the discharge lamp 540.

Hereinafter, referring to FIGS. 2A to 2D, waveforms corresponding to driving voltages and driving currents at the discharge lamps, and the first to fourth feedback voltages OLR1, OLR2, OLP1, and OLP2 will be described.

Figure 2A:
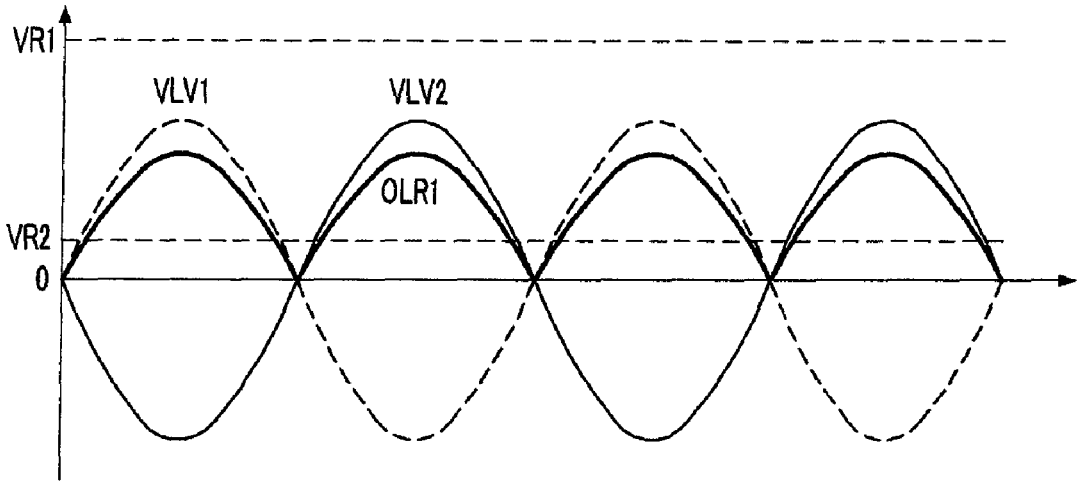
FIG. 2A shows a waveform of a voltage VLV1, a voltage VLV2, and a first feedback voltage OLR1 when discharge lamps 510 and 520 are both steady-state.

FIG. 2A shows waveforms of a voltage VLV1, a voltage VLV2, and a first feedback voltage OLR1 when discharge lamps 510 and 520 are in the normal state. Since the voltage VLV1 and the voltage VLV2 are passed through the diode 311 alternately, the first feedback voltage OLR1 is the rectified waveform.

Figure 2B:
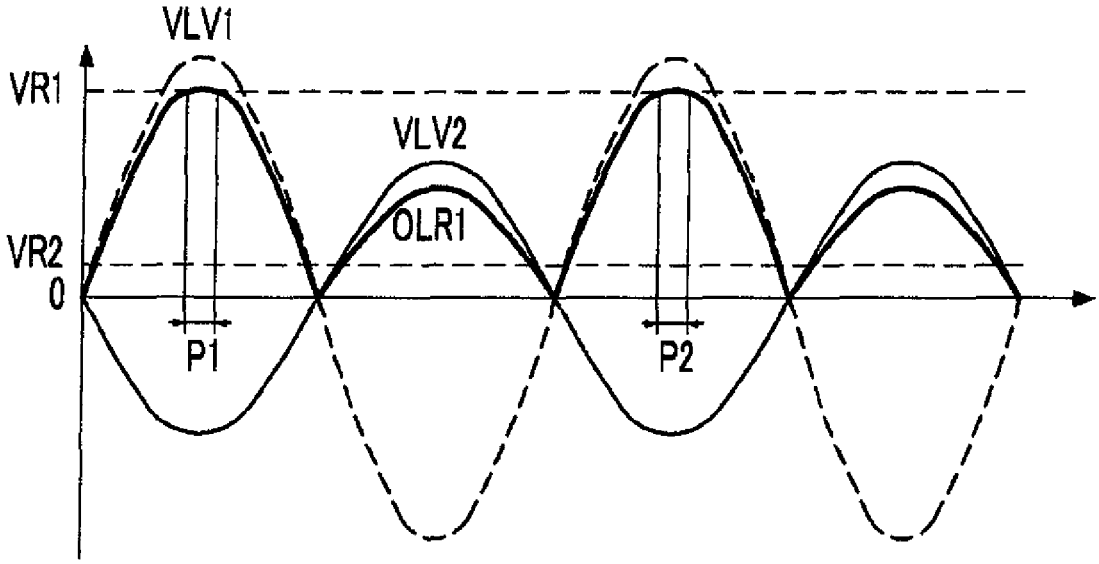
FIG. 2B shows a waveform of the voltage VLV1, the voltage VLV2, and the first feedback voltage OLR1 when the discharge lamp 510 is an open circuit lamp.

In FIG. 2A, a maximum value of the first feedback voltage OLR1 is smaller than a reference voltage VR1, and it is greater than a reference voltage VR2. The maximum value of the first feedback voltage OLR1 is greater than the reference voltage VR1, which means the corresponding discharge lamp is abnormal or the corresponding discharge lamp is an open circuit lamp. The maximum value of the first feedback voltage OLR1 is smaller than the reference voltage VR2, which means the corresponding discharge lamp is a short circuit lamp. FIG. 2B shows waveforms of the voltage VLV1, the voltage VLV2, and the first feedback voltage OLR1 when the discharge lamp 510 is an open circuit lamp.

The voltage VLV1 and the voltage VLV2 are indicated as a dotted line, and a solid line, respectively. The first feedback voltage OLR1 is indicated as a thicker solid line than the solid line indicating the voltage VLV2. As shown in FIG. 2B, time periods P1 and P2 where the maximum value of the first feedback voltage OLR1 is greater than the reference voltage VR1 are generated.

Figure 2C:
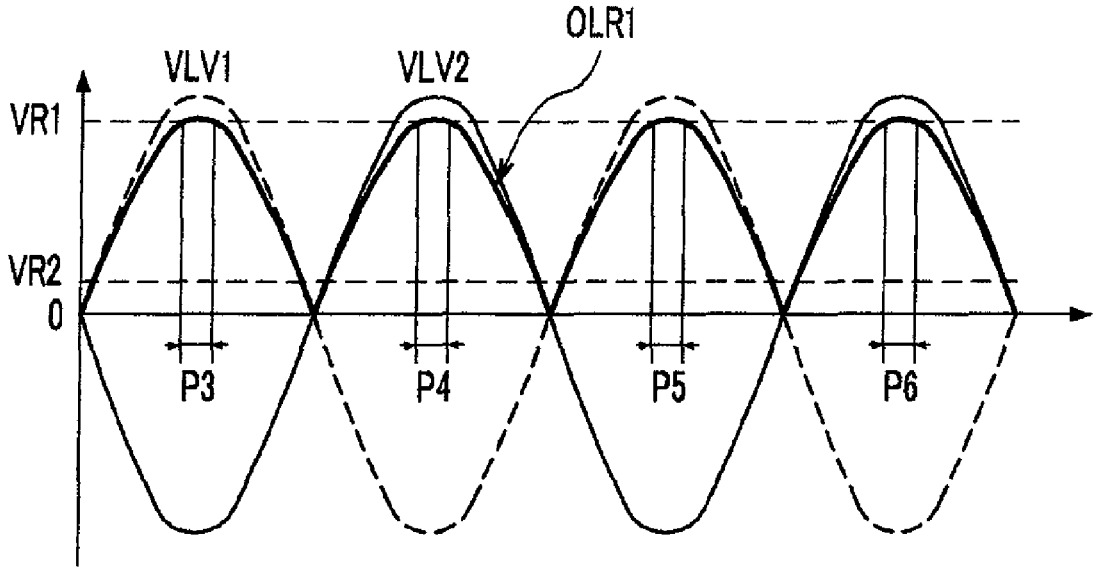
FIG. 2C shows a waveform of the voltage VLV1, the voltage VLV2, and the first feedback voltage OLR1 when the discharge lamps 510 and 520 are both open circuit lamps.

FIG. 2C shows waveforms of the voltage VLV1, the voltage VLV2, and the first feedback voltage OLR1 when the discharge lamps 510 and 520 are open circuit lamps. As shown in FIG. 2C, time periods P3 to P6 where the maximum value of the first feedback voltage OLR1 is greater than the reference voltage VR1 are generated.

Figure 2D:
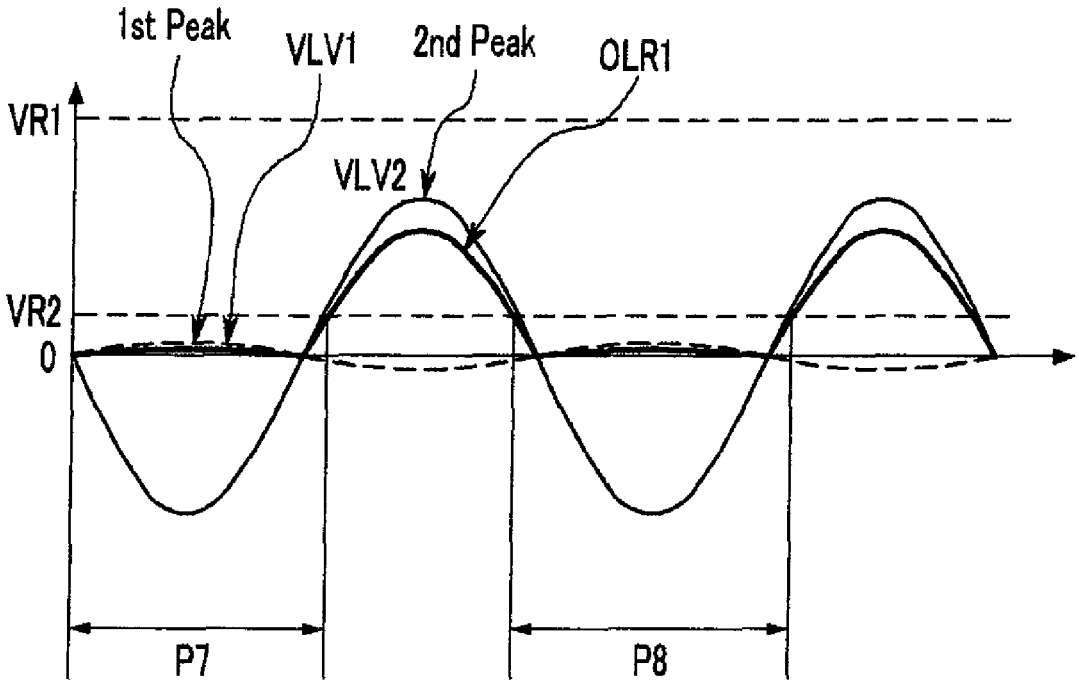
FIG. 2D shows a waveform of the voltage VLV1, the voltage VLV2, and the first feedback voltage OLR1 when the discharge lamp 510 is a short circuit lamp.

FIG. 2D shows waveforms of the voltage VLV1, the voltage VLV2, and the first feedback voltage OLR1 when the discharge lamp 510 is a short circuit lamp. As shown in FIG. 2D, the maximum value of the first feedback voltage OLR1 is smaller than the reference voltage VR2 in time periods P7 and P8. That is, the waveform of the first feedback voltage OLR1 is similar to the half-wave rectified waveform, a first peak of the first feedback voltage OLR1 is smaller than the reference voltage VR2, and a second peak of the first feedback voltage OLR1 is greater than the reference voltage VR2.

Figure 2E:
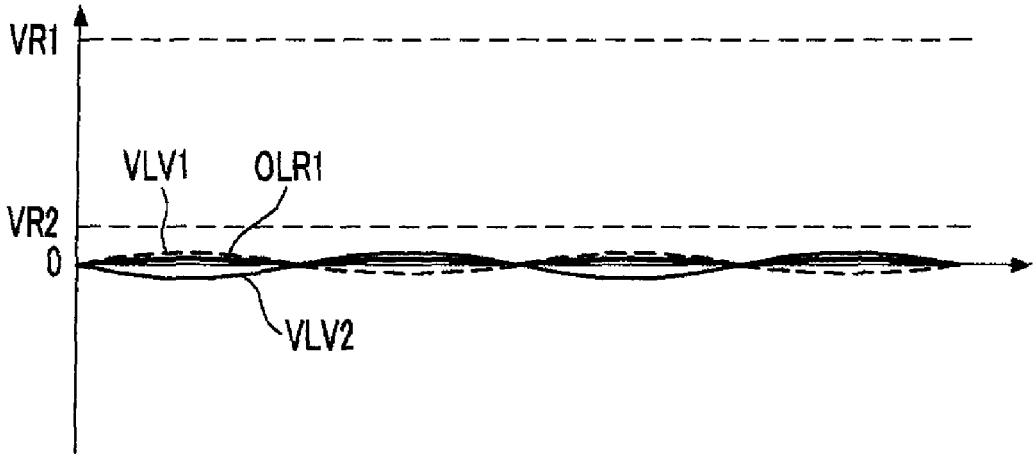
FIG. 2E shows a waveform of the voltage VLV1, the voltage VLV2, and the first feedback voltage OLR1 when the discharge lamps 510 and 520 are both short circuit lamps.

FIG. 2E shows waveforms of the voltage VLV1, the voltage VLV2, and the first feedback voltage OLR1 when the discharge lamps 510 and 520 are short circuit lamps. As shown in FIG. 2E, the maximum value of the first feedback voltage OLR1 is always smaller than the reference voltage VR2.

Figure 3A:
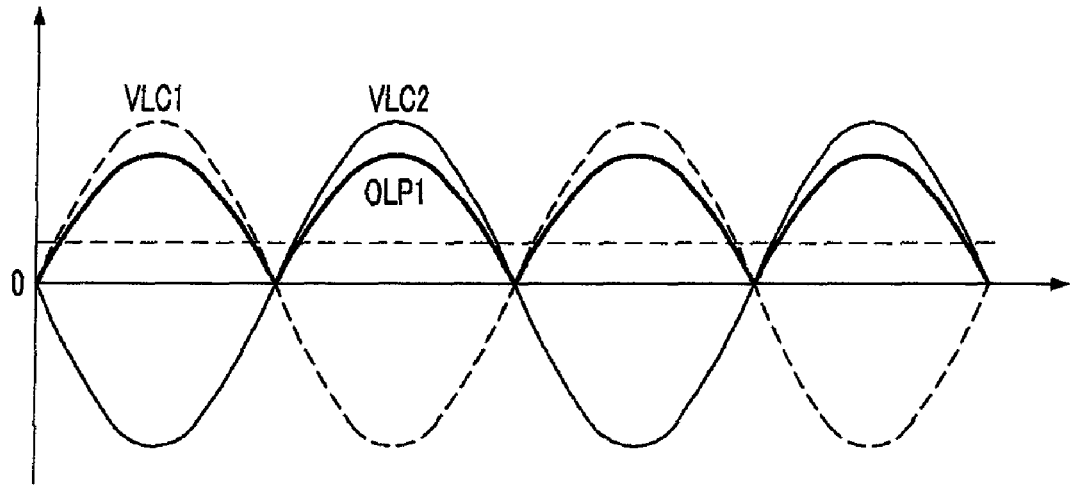
FIG. 3A shows a waveform of a voltage VLC1, a voltage VLC2, and a third feedback voltage OLP1 when the discharge lamps 510 and 520 are both steady-state.

FIG. 3A shows waveforms of a voltage VLC1, a voltage VLC2, and a third feedback voltage OLP1 when the discharge lamps 510 and 520 are in a normal state. Since the voltage VLC1 and the voltage VLC2 are passed through the diode 411 alternately, the third feedback voltage OLP1 is the rectified waveform. The voltage VLC1 and the voltage VLC2 are indicated as a dotted line and a solid line, respectively. The third feedback voltage OLP1 is indicated as a thicker solid line than the solid line indicating the voltage VLC2.

In FIG. 3A, a maximum value of the third feedback voltage OLP1 is greater than the reference voltage VR2. When the maximum value of the third feedback voltage OLP1 is smaller than the reference voltage VR2, the corresponding discharge lamp is open circuit lamp.

Figure 3B:
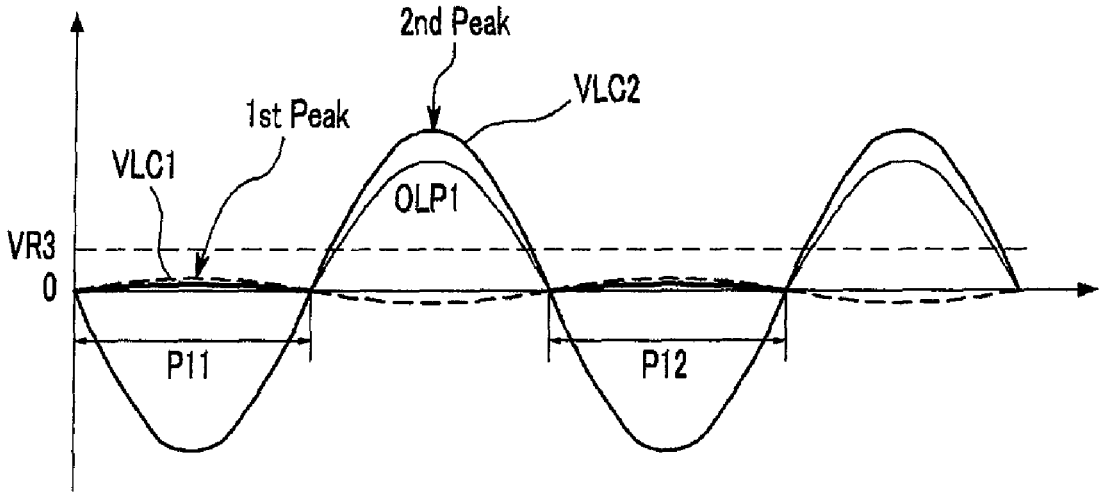
FIG. 3B shows a waveform of the voltage VLC1, the voltage VLC2, and the third feedback voltage OLP1 when the discharge lamp 510 is an open circuit lamp.

FIG. 3B shows waveforms of the voltage VLC1, the voltage VLC2, and the third feedback voltage OLP1 when the discharge lamp 510 is an open circuit lamp. As shown in FIG. 3B, the maximum value of the third feedback voltage OLP1 is smaller than the reference voltage VR3 in time periods P11 and P12. That is, the waveform of the first feedback voltage OLP1 is similar to the half-wave rectified waveform, a first peak of the third feedback voltage OLP1 is smaller than the reference voltage VR3, and a second peak of the third feedback voltage OLP1 is greater than the reference voltage VR3.

Figure 3C:
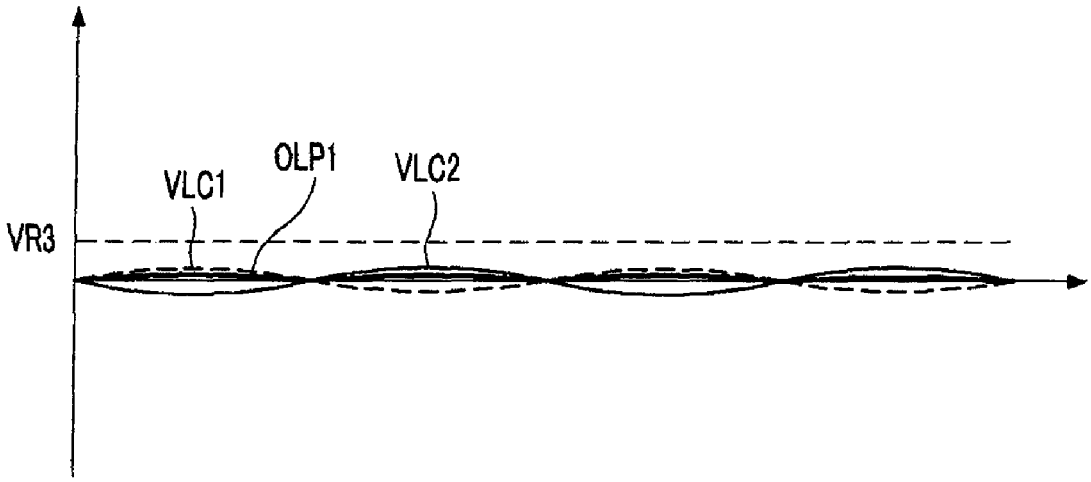
FIG. 3C shows a waveform of the voltage VLC1, the voltage VLC2, and the third feedback voltage OLP1 when the discharge lamps 510 and 520 are both open circuit lamps.

FIG. 3C shows waveforms of the voltage VLC1, the voltage VLC2, and the third feedback voltage OLP1 when the discharge lamps 510 and 520 are open circuit lamps. As shown in FIG. 3C, the maximum value of the third feedback voltage OLP1 is always smaller than the reference voltage VR3. Again referring to FIG. 1, the inverter driver 100 receives the first to fourth feedback voltages OLR1, OLR2, OLP1, and OLP2 from the first to fourth feedback information generation units 310, 320, 410, 420, controls the switch unit 140, and controls each driving voltage and driving current of the discharge lamps 510, 520, 530, and 540. The inverter driver 100 includes a first and second wave rectifiers 110 and 120, a driver 130, first and second max/min detectors 111 and 121, a regular voltage comparator 112, a short circuit comparator 113, an oscillator 114, an open circuit comparator 122, a short circuit lamp protector 150, and an open circuit lamp protector 160. The inverter driver 100 includes a plurality of connection terminals 1 to 7.

The power source voltage Vcc for operating the inverter driver 100 is input through the connection terminal 1, the gate signal VG1 is output to a gate electrode of the transistor 141 through the connection terminal 2, and the gate signal VG2 is output to a gate electrode of the transistor 142 through the connection terminal 3. The first feedback voltage OLR1 is input through the connection terminal 4, and the second feedback voltage OLR2 is input through the connection terminal 5. The third feedback voltage OLP1 is input through the connection terminal 6, and the fourth feedback voltage OLP2 is input through the connection terminal 7.

The first wave rectifier 110 receives and rectifies the first feedback voltage OLR1 and the second feedback voltage OLR2. The second wave rectifier 120 receives and rectifies the third feedback voltage OLP1 and the fourth feedback voltage OLP2. According to an exemplary embodiment of the present invention, in order to drive four lamps, each feedback voltage and feedback current corresponding to the four lamps should be transmitted to the inverter driver 100. For this, the first to fourth feedback information generation units 310, 410, 320, and 420 include diodes D1, D3, D5, and D7. If only two lamps are driven, information about each of driving voltages and each of driving currents of the discharge lamp 510 and the discharge lamp 520 connected to the second coil 202 is necessary.

In this case, the voltage VLV1, the voltage VLV2, the voltage VLC1, and the voltage VLC2 can be directly input to the connection terminal 4, the connection terminal 5, the connection terminal 6, and the connection terminal 7, respectively, without the diodes D1, D3, D5, and D7. Then, the first wave rectifier 110 rectifies the voltage VLV1 and the voltage VLV2, and the second wave rectifier 120 rectifies the voltage VLC1 and the voltage VLC2. The first max/min detector 111 detects a first maximum voltage MAX1 from a higher voltage between the rectified first and second feedback voltages OLR1 and OLR2, and transmits the first maximum voltage MAX1 to the regular voltage comparator 112.

Additionally, the first max/min detector 111 detects a first minimum voltage MIN1 from a lower voltage between the rectified first and second feedback voltages OLR1 and OLR2 and transmits the first minimum voltage MIN1 to the short circuit comparator 113. The second max/min detector 121 detects a second maximum voltage MAX2 from a higher voltage between the rectified third and fourth feedback voltages OLP1 and OLP2, and transmits the second maximum voltage MAX2 to the driver 130. Additionally, the second max/min detector 121 detects a second minimum voltage MIN2 from a lower voltage between the rectified third and fourth feedback voltages OLP1 and OLP2, and transmits the second minimum voltage MIN2 to the open circuit comparator 122. That is, the first max/min detector 111 detects the first maximum voltage MAX1 from a higher voltage between the rectified voltages VLV1 and VLV2 and transmits the first maximum voltage MAX1 to the regular voltage comparator 112.

Additionally, the first max/min detector 111 detects the first minimum voltage MIN1 from a lower voltage between the rectified VLV1 and VLV2 and transmits the first minimum voltage MIN1 to the short circuit comparator 113. The second max/min detector 121 detects the second maximum voltage MAX2 from a higher voltage between the rectified voltages VLC1 and VLC2, and transmits the second maximum voltage MAX2 to the driver 130. Additionally, the second max/min detector 121 detects the second minimum voltage MIN2 from a lower voltage between the rectified voltages VLC1 and VLC2, and transmits the second minimum voltage MIN2 to the open circuit comparator 122.

The regular voltage comparator 112 determines whether the first maximum voltage MAX1 is an excessively high voltage. The reference voltage VR1 is input to an inversion terminal, and the first maximum voltage MAX1 is input to a non-inversion terminal. The reference voltage VR1 is a voltage that determines whether the discharge lamps 510, 520, 530, and 540 are open circuit lamps. The reference voltage VR1 can be set as the maximum value of the corresponding feedback voltage when one of the discharge lamps 510, 520, 530, and 540 become an open circuit lamp. In case an excessive driving voltage is applied to at least one discharge lamp among the discharge lamps 510, 520, 530, and 540 or at least one discharge lamp among the discharge lamps 510, 520, 530, and 540 becomes an open circuit lamp, a time period when the first maximum voltage MAX1 is greater than the reference voltage VR1 is generated.

A protection signal VOR of the regular voltage comparator 112 is generated and output according to a comparison result. When the first maximum voltage MAX1 is more than the reference voltage VR1, a high level protection signal VOR is generated and transmitted to the driver 130. When the high level protection signal VOR is input, after a constant time delay, the driver 130 stops the switching operation of the switch unit 140, and stops supplying the power source to the discharge lamps 510, 520, 530, and 540. The short circuit comparator 113 determines whether the first minimum voltage MIN1 is an excessively low voltage.

The reference voltage VR2 is input to the inversion terminal, and the first minimum voltage MIN1 is input to the non-inversion terminal. The reference voltage VR2 is a voltage that determines whether the discharge lamps 510, 520, 530, and 540 are short circuit lamps. The reference voltage VR2 can be set as the minimum value of the corresponding feedback voltage when one of the discharge lamps 510, 520, 530, and 540 become a short circuit lamp. Since the waveform of the first minimum voltage MIN1 is the rectified sine curve in a normal state, the first minimum voltage MIN1 of normal discharge lamps may be lower than the reference voltage VR2 for a predetermined time period, but a time period when the first minimum voltage MIN1 is more than the reference voltage VR2 exists in a period of the first minimum voltage MIN1. However, in case it is a short circuit lamp, during a period of the first minimum voltage MIN1, the first minimum voltage MIN1 is lower than the reference voltage VR2.

The short circuit comparator 113 transmits the short circuit detection signal VSL according to the comparison result between the first minimum voltage MIN1 and the reference voltage VR2 to the short circuit lamp protector 150. The oscillator 114 generates and transmits a sawtooth wave signal CT having a predetermined period to the short circuit lamp protector 150. A period of the sawtooth wave signal CT corresponds to a half of a switching period of the switch unit 140. The short circuit lamp protector 150 counts periods of the first minimum voltage MIN1 using the short circuit detection signal VSL and periods of the sawtooth wave signal CT, and compares the count results. When the count results are different, the short circuit lamp protector 150 determines that s short circuit is generated. A configuration and an operation of the short circuit lamp protector 150 will be described in more detail referring to FIGS. 4 to 7.

Figure 4:
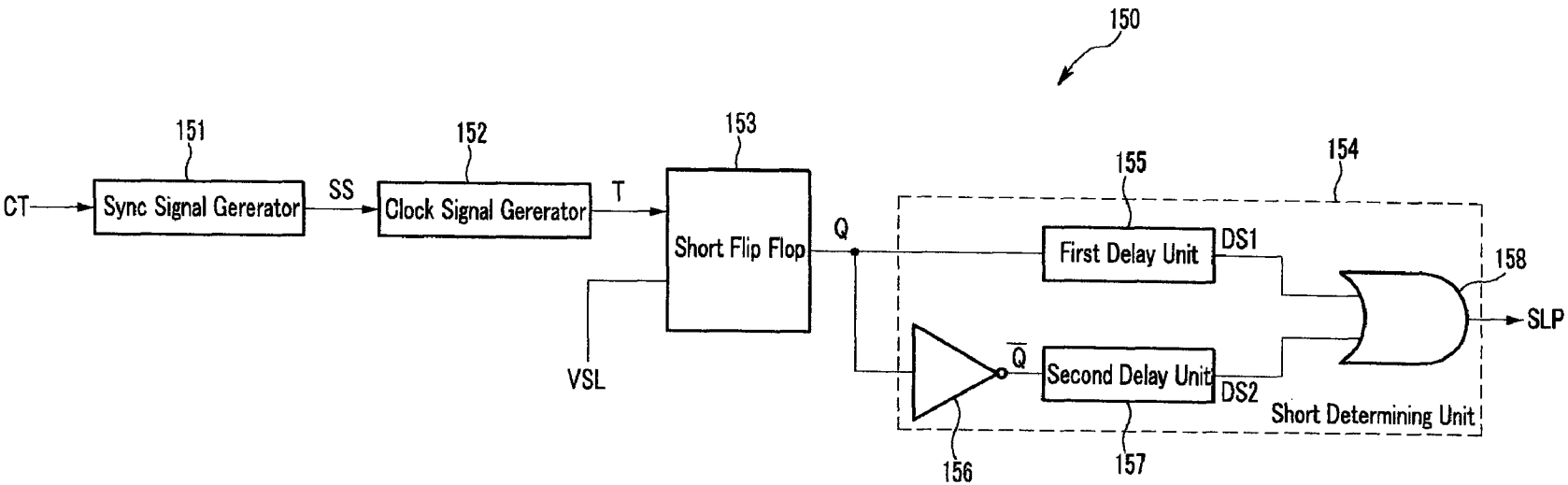
FIG. 4 shows a short circuit lamp protector 150 according to an exemplary embodiment of the present invention.

The short circuit lamp protector 150 uses the short circuit detection signal VSL and a sync signal synchronized with the sawtooth wave signal CT and senses the short circuit lamp. When the short circuit lamp is sensed, a short circuit protection signal SLP is transmitted to the driver 130. When the high level short circuit protection signal SLP is input, after a constant time delay, the driver 130 stops the switching operation of the switch unit 140, and stops supplying the power to the discharge lamps 510, 520, 530, and 540. FIG. 4 shows the short circuit lamp protector 150 according to an exemplary embodiment of the present invention.

The short circuit lamp protector 150 includes a sync signal generator 151, a clock signal generator 152, a short circuit flip-flop 153, and a short circuit determining unit 154.

The sync signal generator 151 generates a sync signal SS synchronized with the sawtooth wave signal CT and having the same period as the sawtooth wave signal CT. According to an exemplary embodiment of the present invention, the sync signal SS is a high level pulse signal during a term when the sawtooth wave signal CT is reduced from a maximum value to a minimum value.

The clock signal generator 152 generates a clock signal T synchronized with the sync signal SS, and a period of the clock signal T is twice the period of the sync signal SS. The clock signal T rises to the high level synchronized with a rising edge time of the sync signal SS, and falls to the low synchronized with the next rising edge time of the sync signal SS level, alternately.

The short circuit flip-flop 153 outputs the clock signal T synchronized with the short circuit detection signal VSL during a period of the short circuit detection signal VSL as a short circuit signal Q.

In detail, the short circuit flip-flop 153 outputs the clock signal T at the rising edge time of short circuit detection signal VSL as the short circuit signal Q by the next rising edge time of the short circuit detection signal VSL.

The short circuit determining unit 154 receives the short circuit signal Q, determines that the short circuit is generated when the level of the short circuit signal Q is not changed for a predetermined time period, and generates the short circuit protection signal SLP.

As described above, if the count result of the period when the first minimum voltage MIN1 is greater than the reference voltage VR2 and the count result of the period of the sawtooth wave signal CT are different, the level of the short circuit signal Q is not changed.

The short circuit determining unit 154 includes a first delay unit 155, an inverter 156, a second delay unit 157, and an OR gate 158. The first delay unit 155 outputs a high level detection signal DS1 after a delay time period Td from a time when the short circuit signal Q becomes a high level. The delay time period Td can be set to predetermined times that are more than the period of the clock signal T.

The first delay unit 155 outputs a low level detection signal DS1 without a delay when the short circuit signal Q becomes a low level. That is, the high level detection signal DS1 is output in case the high level short circuit signal Q is maintained for a time period of more than the delay time period Td. The low level detection signal DS1 is output in the other case.

The inverter 156 inverts the short circuit signal Q and generates an inversion short circuit signal $\overline{Q}$.

The second delay unit 157 outputs a high level detection signal DS2 after the delay time period Td from a time when the inversion short circuit signal $\overline{Q}$ becomes a high level.

The second delay unit 157 outputs a low level detection signal DS2 without a delay when the inversion short circuit signal $\overline{Q}$ becomes a low level. That is, the high level detection signal DS2 is output when the inversion short circuit signal $\overline{Q}$ is maintained for a time period of more than the delay time period Td. The low level detection signal DS2 is output in the other case.

The OR gate 158 performs an OR logical operation with the detection signal DS1 and the detection signal DS2, and generates the short circuit protection signal SLP.

Hereinafter, referring to FIG. 5 and FIG. 6, an inverter driving method will be described in detail.

The delay time period Td is set to a period that is two times the period of the clock signal T.

However, the present invention is not limited thereto. When designing, it may be set appropriately.

Figure 5:
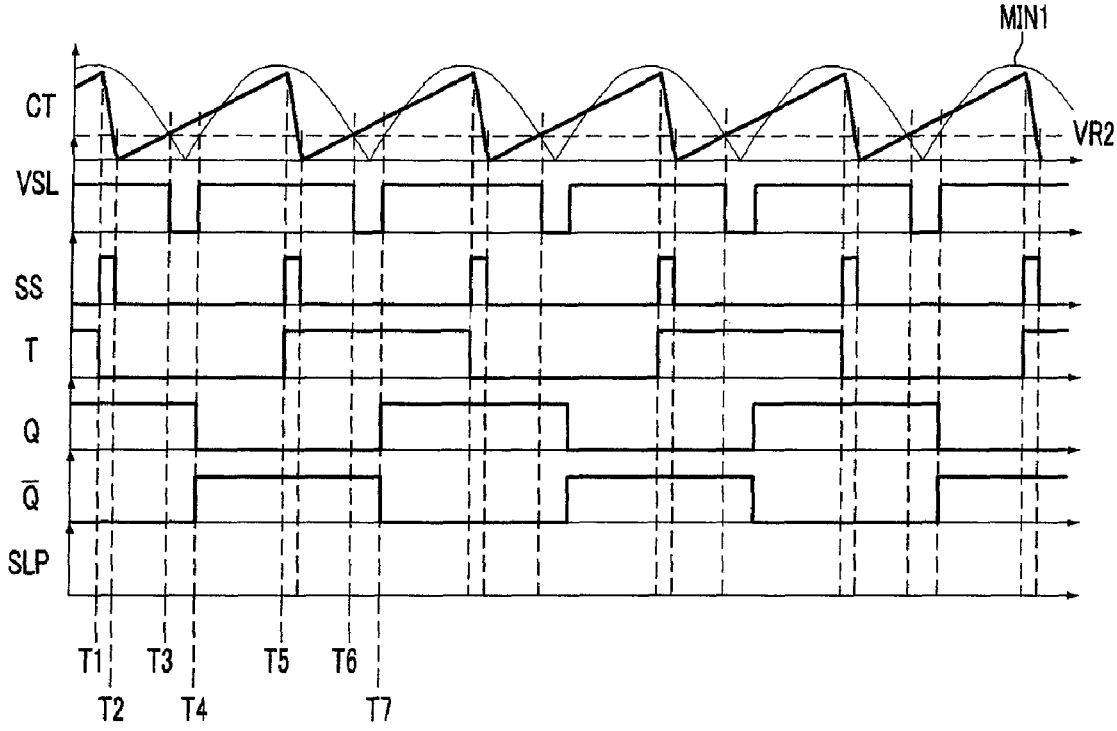
FIG. 5 shows a signal, an internal signal, and an output signal input to the short circuit lamp protector 150 when discharge lamps 510, 520, 530, and 540 are normal lamps.

FIG. 5 shows input signals, internal signals, and an output signal of the short circuit lamp protector 150 when discharge lamps 510, 520, 530, and 540 are normal lamps.

As shown in FIG. 5, a high level pulse of the sync signal SS is generated during the time period from time T1 when the sawtooth wave signal CT is a maximum value to time T2 when the sawtooth wave signal CT is a minimum value. The clock signal T falls to a low level in synchronization with the time T1 being a rising edge time of the sync signal SS. The clock signal T rises to a high level in synchronization with time T5 being a next rising edge time of the sync signal SS.

As above, the level of the clock signal T rises or falls in synchronization with each of the rising edge times of the sync signal SS.

At time T3, when the first minimum voltage MIN1 is smaller than the reference voltage VR2, the short circuit detection signal VSL falls to a low level.

At time T4, when the first minimum voltage MIN1 is greater than the reference voltage VR2, the short circuit detection signal VSL rises to a high level.

Since the clock signal T is a low level at time T4 of a rising edge time when the short circuit detection signal VSL rises to a high level, the short circuit signal Q falls to a low level and the inversion short circuit signal $\overline{Q}$ rises to a high level.

At time T5, when the sync signal SS rises to a high level, the clock signal T rises to a high level.

At time T6, since the first minimum voltage MIN1 is smaller than the reference voltage VR2, the short circuit detection signal VSL falls to a low level.

At time T7, when the minimum voltage MIN1 is greater than the reference voltage VR2, the short circuit detection signal VSL rises to a high level and the short circuit signal Q rises to a high level.

As shown in FIG. 5, the short circuit signal Q and the inversion short circuit signal $\overline{Q}$ alternately fall to a low level for the period of the clock signal T, the detection signals DS1 and DS2 of the first and second delay units 155 and 157 are maintained in a low level, and the OR gate 158 maintains a low level short circuit protection signal SLP.

Figure 6:
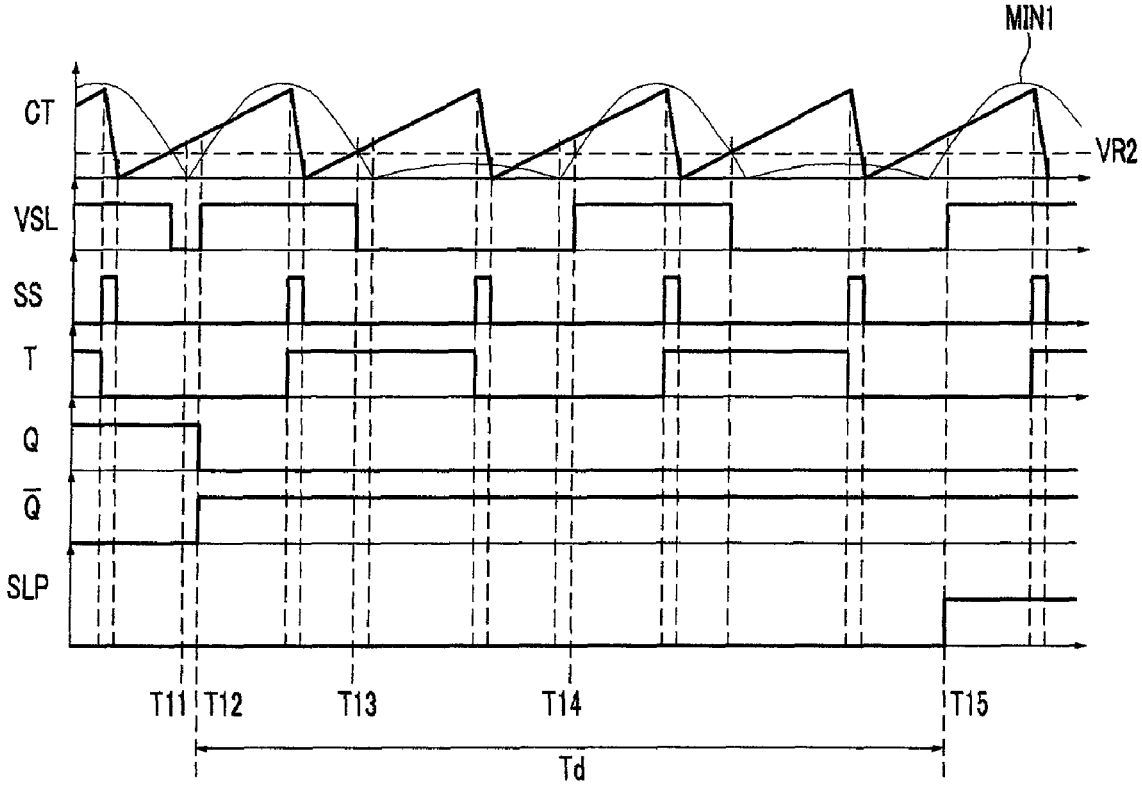
FIG. 6 shows a signal, an internal signal, and an output signal input to the short circuit lamp protector 150 when the short circuit lamp is generated.

FIG. 6 shows input signals, internal signals, and an output signal of the short circuit lamp protector 150 when the short circuit lamp is generated.

FIG. 6 shows a drawing when one discharge lamp of the discharge lamps 510, 520, 530, and 540 is short circuited or two discharge lamps of which driving voltage waveforms are the same phase are short circuited.

The case that two discharge lamps of which driving voltage waveforms are the same phase means that the discharge lamps 510 and 530 of the discharge lamps 510, 520, 530, and 540 are short circuited or the discharge lamp 520 and 540 are short circuited.

Overlapped parts with the description of FIG. 5 will be omitted.

When one discharge lamp of the discharge lamps 510, 520, 530, and 540 is short circuited, the first minimum voltage MIN1 has a similar waveform with the waveform of the OLR1 in FIG. 2D.

From time T11, the first minimum voltage MIN1 begins to increase, and at time T12, the first minimum voltage MIN1 reaches the reference voltage VR2. Then, the short circuit detection signal VSL rises to a high level. Then, the short circuit signal Q falls to a low level according to the clock signal T at the time T12, and the inversion short circuit signal $\overline{Q}$ rises to a high level.

At time T13, the first minimum voltage MIN1 becomes smaller than the reference voltage VR2, and the short circuit detection signal VSL falls to a low level.

At time T14, the first minimum voltage MIN1 reaches the reference voltage VR2, and the short circuit detection signal VSL rises to a high level. Then, the short circuit signal Q maintains a low level according to the clock signal T at the time T14, and the inversion short circuit signal $\overline{Q}$ maintains a high level.

At time T15, when the first minimum voltage MIN1 reaches the reference voltage VR2, the short circuit detection signal VSL becomes a high level. Then, the short circuit signal Q maintains a low level according to the clock signal T at the time T15, and the inversion short circuit signal $\overline{Q}$ maintains a high level.

As shown in FIG. 6, when the inversion short circuit signal $\overline{Q}$ maintains a high level for the delay time period Td, the second delay unit 157 outputs a high level detection signal DS2, and the OR gate 158 outputs a high level short circuit protection signal SLP.

Figure 7:
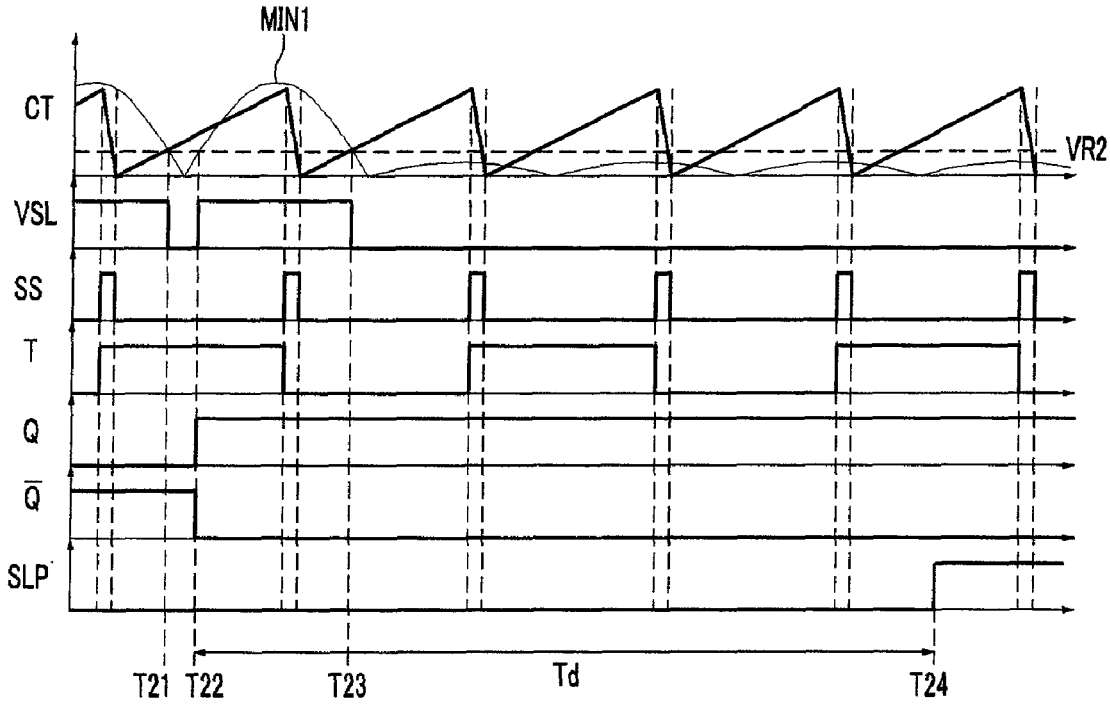
FIG. 7 shows a signal, an internal signal, and an output signal input to the short circuit lamp protector 150 when the short circuit lamp is differently generated from that as shown in FIG. 6.

FIG. 7 shows input signals, internal signals, and an output signal of the short circuit lamp protector 150 when the short circuit lamp is generated in a case that is different from FIG. 6.

FIG. 7 shows the two discharge lamps (510 and 520, 510 and 540, 520 and 530, and 530 and 540) are short circuited or at least three discharges lamps are short circuited.

There is a phase difference of 180° between the two discharge lamps (510 and 520, 510 and 540, 520 and 530, and 530 and 540).

At time T21, the first minimum voltage MIN1 is decreased by the reference voltage VR2 and the short circuit detection signal VSL falls to a low level, and at Time T22, the first minimum voltage MIN1 reaches the reference voltage VR2 and the short circuit detection signal VSL rises to a high level.

At the time T22, a short circuit signal Q rises to a high level according to a clock signal T, and an inversion short circuit signal $\overline{Q}$ falls to a low level.

After time T23, since the first minimum voltage MIN1 is smaller than the reference voltage VR2, the rising edge time of the short circuit detection signal VSL does not occur. Then, the short circuit signal Q and the inversion short circuit signal $\overline{Q}$ are maintained.

As shown in FIG. 7, when the short circuit signal Q is maintained as a high level during the delay time period Td, the first delay unit 156 outputs a high level detection signal DS1, and the OR gate 158 outputs a high level short circuit protection signal SLP at time T24.

In an exemplary embodiment of the present invention, when the discharge lamps are normal, that is, the discharge lamps are not the short circuit lamps and the open circuit lamps, a rectified first minimum voltage MIN1 and the sawtooth wave signal CT have the same period.

In an exemplary embodiment of the present invention, time points when the rectified first minimum voltage MIN1 crosses the reference voltage VR2 are counted, and the first minimum voltage MIN1 is counted as a unit of a period by using counted time points.

Since the first minimum voltage MIN1 alternatively corresponds to each of the two driving voltages of two corresponding discharge lamps among the discharge lamps, a part of the first minimum voltage MIN1 corresponding to the driving voltage of the discharge lamp in which there is a problem between the two corresponding discharge lamps is smaller than the reference voltage VR2.

Since the part is smaller than the reference voltage VR2, the time point crossing the reference voltage VR2 corresponding to the part does not occur.

Therefore, the first minimum voltage MIN1 cannot be counted. As described above, when the result of counting the first minimum voltage MIN1 and the result of counting the sawtooth wave signal are different, it is determined that the short circuit is generated in an exemplary embodiment of the present invention.

Referring to FIG. 1, according to an exemplary embodiment of the present invention, the inverter driver 100 will be described.

An open circuit comparator 122 determines whether the second minimum voltage MIN2 is the excessively lower voltage or not, an inversion terminal of the open circuit comparator 122 receives the reference voltage VR3, and a non-inversion terminal of the open circuit comparator 122 receives the second minimum voltage MIN2.

As the reference voltage VR3 is the voltage in order to determine whether the discharge lamps 510, 520, 530, and 540 are open circuit or not, the reference voltage VR3 is able to be set as a feedback voltage generated by the current flowing through an open circuit lamp among discharge lamps 510, 520, 530, and 540.

Since the waveform of the second minimum voltage MIN2 is the rectified sine curve, the second minimum voltage MIN2 of the normal discharge lamp may be lower than the reference voltage VR3 during the predetermined time period, but the time period when the second minimum voltage MIN2 is greater than the reference voltage VR3 is included in one period of the second minimum voltage MIN2.

However, in the case of the open circuit lamp, during the time period corresponding to one period of the normal lamp, the second minimum voltage MIN2 is lower than the reference voltage VR3.

The open circuit comparator 122 transmits an open circuit detection signal VOL according to the comparison result between the second minimum voltage MIN2 and the reference voltage VR3 to an open circuit lamp protector 160.

The oscillator 114 generates a sawtooth wave signal CT having the predetermined period and transmits the sawtooth wave signal CT to the open circuit lamp protector 160.

The period of the sawtooth wave signal CT corresponds to half the switching period of the switch unit 140.

The open circuit lamp protector 160 uses the open circuit detection signal VOL and counts the number of periods including the time period when the second minimum voltage MIN2 is greater than the reference voltage VR3.

The open circuit lamp protector 160 compares the count result to a count result of counting a number of periods of the sawtooth wave signal CT during the same time, and determines at least one lamp is open circuited among when two count results are different.

The open circuit lamp protector 160 has the same configuration and operation as the short circuit lamp protector 150. However, the open circuit lamp protector 160 receives the open circuit detection signal VOL instead of the short circuit detection signal VSL of the short circuit lamp protector 150, and outputs an open circuit protection signal OLP instead of the short circuit protection signal SLP.

The open circuit lamp protector 160 uses the open circuit detection signal VOL and a sync signal SS synchronized with the sawtooth wave signal CT to sense the open circuit lamp, and transmits a high level open circuit protection signal OLP to the driver 130 when sensing the open circuit lamp.

The driver 130 stops the switching operation of the switch unit 140 after the predetermined time is delayed when the high level open circuit protection signal OLP is input, and then the power source is not supplied to the discharge lamps 510, 520, 530, and 540.

Figure 8:
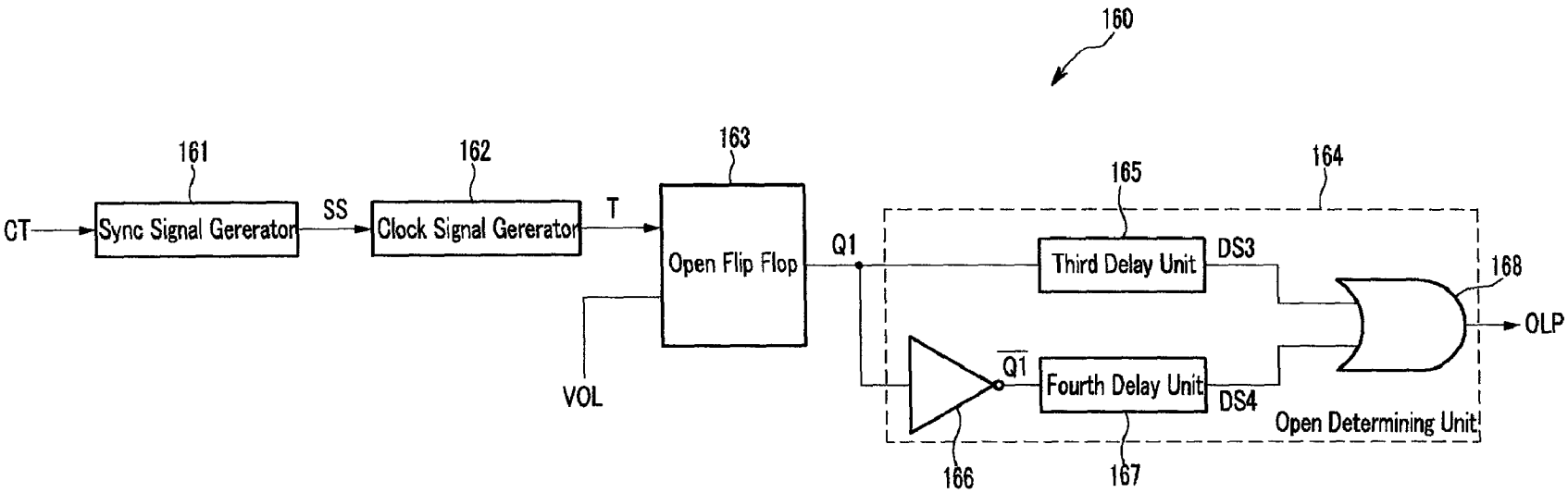
FIG. 8 shows an open circuit lamp protector according to an exemplary embodiment of the present invention.

FIG. 8 shows an open circuit lamp protector according to an exemplary embodiment of the present invention.

The open circuit lamp protector 160 includes a sync signal generator 161, a clock signal generator 162, an open circuit flip-flop 163, and an open circuit determining unit 164.

The sync signal generator 161 generates the sync signal SS being synchronized with the sawtooth wave signal CT. The sync signal SS has a pulse signal that is synchronized with the sawtooth wave signal CT. A period of the sync signal SS is the same as that of the sawtooth wave signal CT.

According to an exemplary embodiment of the present invention, the pulse of the sync signal SS is a high level pulse signal during the time period when the sawtooth wave signal CT is decreased from the maximum value to the minimum value.

The clock signal generator 162 generates the clock signal T being synchronized with the sync signal SS. The clock signal generator alternatively raises or lowers the clock signal T synchronized with the rising edge time of the sync signal SS 162, a period of the clock signal T is two times that of the sync signal SS, an the clock signal T has a high level and a low level alternatively synchronized with the rising edge time of the sync signal SS 162.

The open circuit flip-flop 163 outputs the clock signal T synchronized with the open circuit detection signal VOL as the open circuit signal Q1 during one period of the open circuit detection signal VOL. In detail, the open circuit flip-flop 163 outputs the clock signal T at the rising edge time of the open circuit detection signal VOL as the open circuit signal Q1 by the next rising edge time of the open circuit detection signal VOL.

The open circuit determining unit 164 receives the open circuit signal Q1 and determines whether at least one among the discharge lamps is open circuited using the open circuit signal Q1.

The open circuit determining unit 164 determines that at least one among the discharge lamps is open circuited when the level of the open circuit signal Q1 is not changed during a predetermined time period, and generates the open circuit protection signal OLP.

When the count result of a number of the second minimum voltage (MIN2) periods including the time period when the second minimum voltage MIN2 is greater than the reference voltage VR3 and the count result of a number of the sawtooth wave signal (CT) periods are different, the level of the open circuit signal Q1 is not changed.

The open circuit determining unit 164 includes a third delay unit 165, an inverter 166, a fourth delay unit 167, and an OR gate 168.

The third delay unit 165 outputs a high level detection signal DS3 after a predetermined delay time period Td from the time when the open circuit signal Q1 rises to a high level.

The delay time period Td can be set to be greater than the predetermined number of the clock signal (T) periods.

The third delay unit 165 outputs a low level detection signal DS3 without a delay when the open circuit signal Q1 falls to a low level. That is, the third delay unit 165 outputs the high level detection signal DS3 in the case that the open circuit signal Q1 is maintained in the high level for the delay time period Td. Except for this case, the third delay unit 165 always outputs the low level detection signal DS3.

The inverter 166 reverses the open circuit signal Q1 and generates the inversion open circuit signal $\overline{Q}$1.

The fourth delay unit 167 outputs the high level detection signal DS3 after the delay time period Td from the time when the inversion open circuit signal $\overline{Q}$1 rises to a high level.

The fourth delay unit 167 outputs the low level detection signal DS4 without a delay when the inversion open circuit signal DeletedTexts falls to a low level.

That is, the fourth delay unit 167 outputs the high level detection signal DS4 in the case that the inversion open circuit signal DeletedTexts is maintained in the high level for the delay time period Td. Except for this case, the fourth delay unit 167 always outputs the low level detection signal DS4.

The OR gate 168 performs an OR operation with the detection signal DS3 and the detection signal DS4, and generates the open circuit protection signal OLP.

The operation of the open circuit lamp protector 160 is the same as the operation of the short circuit lamp protector 150.

In FIGS. 5 to 7, when the open circuit detection signal VOL can be generated like the short circuit detection signal VSL, the other signals also have the same waveform. Thus, instead of the short circuit protection signal SLP, the open circuit protection signal OLP is generated.

The driver 130 receives the second maximum voltage MAX2 of the second max/min detector 121 and controls brightness of the discharge lamps 510, 520, 530, and 540. The driver 130 uses the second maximum voltage MAX2 and detects currents flowing through the discharge lamps 510, 520, 530, and 540. The driver 130 controls the switching operation of the switch unit 140, and controls driving currents supplied to the discharge lamps.

As described above, according to an exemplary embodiment of the present invention, the driving voltages and the driving currents of the discharge lamps are transmitted through the diode, and the open circuit lamp and the short circuit lamp are able to be sensed.

Conventionally, many diodes according to the number of discharge lamps are needed. But the feedback voltages regarding a driving voltage and a driving current of four discharge lamps through four diodes can be transmitted to the inverter driver in the embodiment of the present invention.

Accordingly, the present invention can provide an inverter and the driving method for finding an open circuit lamp and a short circuit lamp with a simple configuration.

The detailed description of the invention and the drawings are only illustrative of the present invention, and are not to be used to limit the range of the present invention described in the appended claims.

Thus, the point that various changes and equivalents of other embodiments are possible for a person of ordinary skill in the technical field to realize.

Therefore, the range of true technical protection of the present invention should be determined with the technical idea of the appended claims.

What is claimed is:

1. An inverter for supplying power to at least two discharge lamps, comprising:

a first feedback information generation unit for generating a first feedback voltage corresponding to a driving voltage of a first discharge lamp of the at least two discharge lamps;

a second feedback information generation unit for generating a second feedback voltage corresponding to a driving voltage of a second discharge lamp of the at least two discharge lamps; and an inverter driver for comparing a first minimum voltage having a smaller feedback voltage of the first and second feedback voltages and a short circuit reference voltage in order to determine at least one short circuit discharge lamp of the at least two discharge lamps and for sensing the at least one short circuit discharge lamp by using the comparison result and a first sawtooth wave signal having a predetermined period.

2. The inverter of claim 1, further comprising:

a third feedback information generation unit for generating a third feedback voltage corresponding to a driving current of the first discharge lamp; and a fourth feedback information generation unit for generating a fourth feedback voltage corresponding to a driving current of the second discharge lamp, wherein the inverter driver compares a second minimum voltage having a smaller feedback voltage of the third and fourth feedback voltages and an open circuit reference voltage in order to determine at least one open circuit discharge lamp of the least two discharge lamps, and senses the at least one open circuit discharge lamp by using the comparison result and the first sawtooth wave signal.

3. The inverter of claim 2, wherein the inverter driver comprises:

an open circuit comparator for comparing the second minimum voltage and the open circuit reference voltage and for generating an open circuit detection signal according to the comparison result; and an open circuit lamp protector for counting a number of the second minimum voltage periods including a time period when the second minimum voltage is greater than the open circuit reference voltage by using the open circuit detection signal and for determining that the at least one open circuit discharge lamp is present if the count result is different from a count result of a number of the first sawtooth wave signal periods.

4. The inverter of claim 3, wherein the open circuit lamp protector comprises:

a sync signal generator for generating a sync signal being a pulse signal that is synchronized with the first sawtooth wave signal and has a same period as the first sawtooth wave signal;

a clock signal generator for generating a clock signal that is synchronized with the sync signal and has twice the period than the period of the sync signal;

an open circuit flip-flop for outputting the clock signal as an open circuit signal during one period of the open circuit detection signal in synchronization with the open circuit detection signal; and an open circuit determining unit for determining that the at least one open circuit discharge lamp is present when the level of the open circuit signal is not changed during a predetermined delay time period.

5. The inverter of claim 4, wherein the open circuit determining unit comprises:

a first delay unit for generating a second level first detection signal when the open circuit signal is maintained in the first level during the predetermined delay time period and a fourth level first detection signal when the open circuit signal is a third level;

a second delay unit for generating a second level second detection signal when an inversion open circuit signal of which the open circuit signal is inverted is maintained in the first level during the predetermined delay time period and a fourth level second detection signal when the inversion open circuit signal is the third level; and an operator for generating an open circuit protection signal when the first detection signal or the second detection signal is the second level.

6. The inverter of claim 2, further comprising:

a switch unit for receiving a power source voltage and for generating a square wave voltage by a switching operation; and a transformer for including at least two second side coils supplying the driving voltages and the driving currents to the at least two discharge lamps by using the square wave voltage.

7. The inverter of claim 6, wherein the first discharge lamp is connected to a first terminal of the second coil of the at least two second side coils, and a third discharge lamp is connected to a second terminal of the second coil, and wherein the third feedback information generation unit includes:

a first resistor through which the driving current of the first discharge lamp flows;

a second resistor through which a driving current of the third discharge lamp flows;

a first diode including an anode to which a voltage of the first resistor is applied; and a second diode including an anode to which a voltage of the second resistor is applied and the cathode connected to a cathode of the first diode, wherein the third feedback voltage is a cathode voltage of the first and second diodes.

8. The inverter of claim 6, wherein the second discharge lamp is connected to a first terminal of a third coil of at least two second side coils, and the third discharge lamp is connected to a second terminal of the third coil, wherein the fourth feedback information generation unit includes:

a first resistor through which the driving current of the second discharge lamp flows;

a second resistor through which a driving current of the third discharge lamp flows;

a first diode including an anode to which a voltage of the first resistor is applied; and a second diode including an anode to which a voltage of the second resistor is applied and the cathode of which is connected to a cathode of the first diode, and wherein the fourth feedback voltage is a cathode voltage of the first and second diodes.

9. The inverter of claim 6, wherein a period of the first sawtooth wave signal is a half of a period of the switching operation.

10. The inverter of claim 1, wherein the inverter driver of the inverter includes:

a short circuit comparator for comparing the first minimum voltage and the short circuit reference voltage and for generating a short circuit detection signal according to the comparison result; and a short circuit lamp protector for counting a number of the first minimum voltage periods that includes a time period when the first minimum voltage is greater than the short circuit reference voltage by using the short circuit detection signal and for determining that the at least one short circuit discharge lamp is present when the count result is different from a count result of a number of the first sawtooth wave signal periods.

11. The inverter of claim 10, wherein the short circuit lamp protector includes:

a sync signal generator for generating a sync signal being a pulse signal that is synchronized with the first sawtooth wave signal and has a same period as the first sawtooth wave signal;

a clock signal generator for generating a clock signal that is synchronized with the sync signal and has twice the period of that of the sync signal;

a short circuit flip-flop for outputting the clock signal as a short circuit signal during one period of the short circuit detection signal in synchronization with the short circuit detection signal; and a short circuit determining unit for determining that the at least one short circuit discharge lamp is present when the level of the short circuit signal is not changed during a predetermined delay time period.

12. The inverter of claim 11, wherein the short circuit determining unit includes:

a first delay unit for generating a second level first detection signal when the short circuit signal is maintained in the first level during the predetermined delay time period and a fourth level first detection signal when the short circuit signal is a third level;

a second delay unit for generating a second level second detection signal when an inversion short circuit signal of which the short circuit signal is inverted is maintained in the first level during the predetermined delay time period and a fourth level second detection signal when the inversion short circuit signal becomes the third level; and an operator for generating a short circuit protection signal when the first detection signal or the second detection signal is the second level.

13. The inverter of claim 1, further comprising:

a switch unit for receiving a power source voltage and for generating a square wave voltage by a switching operation; and a transformer for including at least two second side coils supplying the driving voltages and the driving currents to the at least two discharge lamps by using the square wave voltage.

14. The inverter of claim 13, wherein the first discharge lamp is connected to a first terminal of a second coil of the at least two second side coils, and a third discharge lamp is connected to a second terminal of the second coil, wherein the first feedback information generation unit includes:

a first capacitor including a first terminal connected to the first discharge lamp and the first terminal of the second coil;

a second capacitor including a first terminal connected to a second terminal of the first capacitor;

a first diode including an anode to which a voltage of the first terminal of the second capacitor is applied;

a third capacitor including a first terminal connected to the third discharge lamp and the second terminal of the second coil;

a fourth capacitor including a first terminal connected to a second terminal of the third capacitor; and a second diode including an anode to which a voltage of the first terminal of the fourth capacitor is applied and a cathode connected to a cathode of the first diode, wherein the first feedback voltage is a cathode voltage of the first and second diodes.

15. The inverter of claim 13, wherein the second discharge lamp is connected to a first terminal of a second coil of the at least two second side coils, and a third discharge lamp is connected to a second terminal of the second coil, wherein the second feedback information generation unit includes:

a first capacitor including a first terminal connected to the second discharge lamp and the first terminal of the second coil;

a second capacitor including a first terminal connected to a second terminal of the first capacitor;

a first diode including an anode to which a voltage of the first terminal of the second capacitor is applied;

a third capacitor including a first terminal connected to the third discharge lamp and the second terminal of the second coil;

a fourth capacitor including a first terminal connected to a second terminal of the third capacitor; and a second diode including an anode to which a voltage of the first terminal of the fourth capacitor is applied and a cathode connected to a cathode of the first diode, and wherein the second feedback voltage is a cathode voltage of the first and second diodes.

16. The inverter of claim 13, wherein a period of the first sawtooth wave signal is a half of a period of the switching operation.

17. A driving method of an inverter for supplying a power source to at least two discharge lamps, comprising:

a step for generating a first feedback voltage corresponding to a driving voltage of a first discharge lamp of the at least two discharge lamps;

a step for generating a second feedback voltage corresponding to a driving voltage of a second discharge lamp of the at least two discharge lamps;

a step for generating a first minimum voltage having a smaller feedback voltage by comparing the first and second feedback voltages;

a step for comparing the first minimum voltage to a short circuit reference voltage in order to determine whether at least one short circuit discharge lamp of the at least two discharge lamps is present; and a step for sensing the at least one short circuit discharge lamp of the at least two discharge lamps by using the comparison result and a first sawtooth wave signal having a predetermined period.

18. The driving method of the inverter of claim 17, further comprising:

a step for generating a third feedback voltage corresponding to a driving current of the first discharge lamp;

a step for generating a fourth feedback voltage corresponding to a driving current of the second discharge lamp;

a step for generating a second minimum voltage having a smaller feedback voltage of the third and fourth feedback voltages;

a step for comparing the second minimum voltage to an open circuit reference voltage in order to determine whether at least one open circuit discharge lamp of the at least two discharge lamps is present; and a step for sensing the open circuit lamp by using the comparison result and the first sawtooth wave signal.

19. The driving method of the inverter of claim 18, wherein the step for sensing the open circuit lamp includes:

a step for comparing the second minimum voltage and the open circuit reference voltage and generating an open circuit detection signal according to the comparison result;

a step for counting a number of second minimum voltage periods that include a time period when the second minimum voltage is greater than the open circuit reference voltage by using the open circuit detection signal; and a step for determining that at least one open circuit discharge lamp is present when the count result is different from a count result of a number of the first sawtooth wave signal periods.

20. The driving method of the inverter of claim 17, wherein the step for determining the short circuit lamp includes:

a step for comparing the first minimum voltage to the short circuit reference voltage and generating a short circuit detection signal according to the comparison result;

a step for counting a number of first minimum voltage periods that include a time period when the first minimum voltage is greater than the short circuit reference voltage by using the short circuit detection signal; and a step for determining that the at least one short circuit discharge lamp is present when the count result is different from the first sawtooth wave signal period count result.

21. An inverter for supplying a power source to at least two discharge lamps, comprising:

a first feedback information generation unit for generating a first voltage and a second voltage corresponding to each driving voltage of the at least two discharge lamps; and an inverter driver that respectively rectifies the first voltage and the second voltage, compares a first minimum voltage having a smaller voltage of the rectified first voltage and the rectified second voltage to a short circuit reference voltage in order to determine whether at least one short circuit discharge lamp of the at least two discharge lamps is present, and senses the at least one short circuit discharge lamp of the at least two discharge lamps by using the comparison result and a first sawtooth wave signal having a predetermined period.

22. The inverter of claim 21, further comprising a second feedback information generation unit for generating a third voltage and a fourth voltage corresponding to each driving current of the at least two discharge lamps, and the inverter driver respectively rectifies the third voltage and the fourth voltage, compares a second minimum voltage having a smaller voltage of the rectified third and fourth voltages to an open circuit reference voltage in order to determine whether at least one open circuit discharge lamp of the at least two discharge lamps is present, and senses the at least one open circuit discharge lamp of the at least two discharge lamps by using the comparison result and the first sawtooth wave signal.

23. The inverter of claim 22, wherein the inverter driver includes:

an open circuit comparator for comparing the second minimum voltage and the open circuit reference voltage and for generating an open circuit detection signal according to the comparison result; and an open circuit lamp protector for counting a number of second minimum voltage periods including a time period when the second minimum voltage is greater than the open circuit reference voltage by using the open circuit detection signal and for determining that the at least one open circuit discharge lamp is present if the count result is different from a count result of a number of the first sawtooth wave signal periods.

24. The inverter of claim 23, wherein the open circuit lamp protector includes:

a sync signal generator for generating a sync signal being a pulse signal that is synchronized with the first sawtooth wave signal and has a same period as the first sawtooth wave signal;

a clock signal generator for generating a clock signal that is synchronized with the sync signal and has twice the period of the sync signal;

an open circuit flip-flop for outputting the clock signal as an open circuit signal during one period of the open circuit detection signal in synchronization with the open circuit detection signal; and an open circuit determining unit for determining that the at least one open circuit discharge lamp is present when the level of the open circuit signal is not changed during a predetermined delay time period.

25. The inverter of claim 24, wherein the open circuit determining unit includes:

a first delay unit for generating a second level first detection signal when the open circuit signal is maintained in the first level during the predetermined delay time period and a fourth level first detection signal when the open circuit signal is a third level;

a second delay unit for generating a second level second detection signal when an inversion open circuit signal of which the open circuit signal is inverted is maintained in the first level during the predetermined delay time period and a fourth level second detection signal when the inversion open circuit signal is the third level; and an operator for generating an open circuit protection signal when the first detection signal or the second detection signal is the second level.

26. The inverter of claim 21, wherein the inverter driver includes:

a short circuit comparator for comparing the first minimum voltage and the short circuit reference voltage and for generating a short circuit detection signal according to the comparison result; and a short circuit lamp protector for counting a number of first minimum voltage periods that include a time period when the first minimum voltage is greater than the short circuit reference voltage by using the short circuit detection signal and for determining that the at least one short circuit discharge lamp is present when the count result is different from a count result of a number of the first sawtooth wave signal periods.

27. The inverter of claim 26, wherein the short circuit lamp protector includes:

a sync signal generator for generating a sync signal being a pulse signal that is synchronized with the first sawtooth wave signal and has a same period as the first sawtooth wave signal;

a clock signal generator for generating a clock signal that is synchronized with the sync signal and has twice period than of that of the sync signal;

a short circuit flip-flop for outputting the clock signal as the short circuit signal during one period of the short circuit detection signal in synchronization with the short circuit detection signal; and a short circuit determining unit for determining that the at least one short circuit discharge lamp is present when the level of the short circuit signal is not changed during a predetermined delay time period.

28. The inverter of claim 27, wherein the short circuit determining unit includes:

a first delay unit for generating a second level first detection signal when the short circuit signal is maintained in the first level during the predetermined delay time period and a fourth level first detection signal when the short circuit signal is a third level;

a second delay unit for generating a second level second detection signal when an inversion short circuit signal of which the short circuit signal is inverted is maintained in the first level during the predetermined delay time period and a fourth level second detection signal when the inversion short circuit signal becomes the third level; and an operator for generating a short circuit protection signal when the first detection signal or the second detection signal is the second level.

* * * * *